US010710266B2

(12) United States Patent
Ulrich

(10) Patent No.: US 10,710,266 B2
(45) Date of Patent: Jul. 14, 2020

(54) APPARATUS AND METHOD FOR MAKING CORNER BOARDS FOR CONTAINER ASSEMBLIES

(71) Applicant: Clyde Ulrich, Kingsburg, CA (US)

(72) Inventor: Clyde Ulrich, Kingsburg, CA (US)

( * ) Notice: Subject to any disclaimer, the term of this patent is extended or adjusted under 35 U.S.C. 154(b) by 61 days.

(21) Appl. No.: 16/029,474

(22) Filed: Jul. 6, 2018

(65) Prior Publication Data

US 2018/0311858 A1 Nov. 1, 2018

Related U.S. Application Data

(62) Division of application No. 14/806,512, filed on Jul. 22, 2015, now Pat. No. 10,046,473.

(60) Provisional application No. 62/044,351, filed on Sep. 1, 2014.

(51) Int. Cl.

| | |
|---|---|
| ***B26F 1/12*** | (2006.01) |
| ***B65D 81/05*** | (2006.01) |
| ***B21D 28/02*** | (2006.01) |
| *B26F 1/44* | (2006.01) |

(52) U.S. Cl.

CPC ..... *B26F 1/12* (2013.01); *B21D 28/02* (2013.01); *B65D 81/054* (2013.01); *B26F 2001/4427* (2013.01); *B65D 2581/053* (2013.01)

(58) Field of Classification Search

CPC ..... B26F 1/12; Y10T 29/49671; Y10T 29/49995; Y10T 29/49472; Y10T 29/5116; Y10T 29/49922

See application file for complete search history.

(56) References Cited

U.S. PATENT DOCUMENTS 2,220,910 A * 11/1940 Kershaw ..... H01J 9/04 30/34.2
3,270,541 A * 9/1966 Tishken ..... B21D 5/08 72/132
3,580,469 A * 5/1971 Reese ..... B65D 81/056 206/521

* cited by examiner

*Primary Examiner* — Jason L Vaughan
*Assistant Examiner* — Amanda Kreiling
(74) *Attorney, Agent, or Firm* — Andrew D. Fortney; Central California IP Group, P.C.

(57) ABSTRACT

An apparatus and method for manufacturing a notched corner board is disclosed. The method includes cutting bent board stock into fixed lengths; forming a slit in or near an end of the corner board; and bending/folding a part of the corner board between the end and the slit to create a notch or flap in the corner board. The apparatus includes one or more cutting tools configured to form a slit in or near a first end of the corner board, a support block configured to support the corner board as the slit is formed, one or more rollers configured to move the corner board towards the cutting tool(s), a frame to which the cutting tool(s), the support block, and the roller(s) are directly or indirectly attached, a motor, and a punch. The motor controls movement of the punch to form the notch in the corner board.

20 Claims, 9 Drawing Sheets

APPARATUS AND METHOD FOR MAKING CORNER BOARDS FOR CONTAINER ASSEMBLIES

CROSS REFERENCE TO RELATED APPLICATION

This application is a divisional of U.S. patent application Ser. No. 14/806,512, filed Jul. 22, 2015, which claims the benefit of U.S. Provisional Patent Application No. 62/044,351, filed on Sep. 1, 2014, each of which is incorporated herein by reference as if fully set forth herein.

FIELD OF THE INVENTION

The present invention generally relates to the field of apparatuses/machines and methods for making corner boards. More specifically, embodiments of the present invention pertain to a machine and method for making notched corner boards for securing container assemblies (e.g., with plastic wrap, one or more straps, or other mechanism for securing a container assembly).

DISCUSSION OF THE BACKGROUND

Containers are used for holding and/or storing materials. Multiple containers can be stacked together as a single unit for various reasons, such as storage, transportation, or other operations involving multiple containers. For instance, multiple containers may be placed onto a pallet, for storage in a warehouse and/or loading onto a trailer for transportation (e.g., from a distribution warehouse to a store). When moving a pallet of containers by forklift, the forklift operator may inadvertently strike the edge of the pallet into a wall, shelving bracket, vehicle or even other container(s). Unexpected movement during transportation of the containers can also cause stacks to become unstable or fall, or otherwise become damaged. As a result, the manipulation of such containers or container stacks may result in damage to the exterior of the container(s) and/or the contents therein.

Corner boards may be placed on corners of container stacks to hold the stacks in place and/or mitigate damage to the containers. Conventionally, corner boards are attached to the exterior edges of the container stacks using staples or tape. However, these methods for attaching corner boards are relatively time-consuming and require additional materials to be used with the corner boards. Further, these methods of attaching corner boards may create safety risks; for example, a person could become injured from the staple(s) that may protrude from the corner board when removing the stapled corner board(s) from the group of containers, or be cut when cutting the tape with a knife or box cutter. These methods for affixing corner boards may also damage the container(s) and/or their contents. For example, the staple used to attach the corner board may pierce the contents within the underlying container, or the tape may tear the exterior surface of the container, which frequently has a protective, moisture resistant or finished/decorative outer surface.

Recently, corner boards with notches or bendable flaps have been made (see, e.g., U.S. patent application Ser. No. 13/904,967 and U.S. Provisional Pat. Appl. No. 61/984,676, respectively filed on 29 May 2013 and 25 Apr. 2014. Therefore, it is desirable to provide a machine that makes notched corner boards or corner boards with easily bendable flaps, which can be easily placed on a container stack without the need to use additional means to affix the corner board to the container(s).

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY OF THE INVENTION

Embodiments of the present invention relate to an apparatus or machine that makes notched corner boards that advantageously hold container stacks in place, eliminate and/or minimize damage to the containers, and reduce or minimize expenses due to damaged containers and/or container contents.

One aspect of the present invention relates to an apparatus for forming a slit corner board that simultaneously cuts the board stock and forms the slit. In various embodiments of the apparatus, an attachment is configured to form the flap(s) simultaneously with or immediately after cutting the board stock and/or forming the slit(s).

Another aspect of the present invention relates to a method of manufacturing a hangable corner board that includes cutting bent board stock into fixed lengths; forming at least one slit in or near a first end of the corner board; and bending or folding a part of the corner board between the first end and the slit(s) to create a notch or flap adapted to rest, seat or hang the corner board on or from a substantially horizontal surface. In various embodiments, the method includes making one or more slits in the center of the corner board, at or across the bend, near to and parallel or substantially parallel with the first end of the corner board. Alternatively, the method includes making two or more slits at on in the outer edge of the corner board, parallel or substantially parallel with the first end of the corner board, or in the first end of the corner board, parallel or substantially parallel with an outer edge of the corner board. Further embodiments of the method include bending a board stock to form the bent board stock, the bent board stock having first and second sides with an angle therebetween.

These and other advantages of the present invention will become readily apparent from the description of various embodiments below.

DETAILED DESCRIPTION

Reference will now be made in detail to various embodiments of the invention, examples of which are illustrated in the accompanying drawing(s). In order to achieve the objectives, technical solutions and advantages of the present invention more clearly, further details of the invention are described below with regard to the Figure(s). While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention as defined by the appended claims. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures, components, and attachment equipment have not been described in detail so as not to unnecessarily obscure aspects of the present invention. The embodiments described here are only used to explain, rather than limit, the invention.

In the context of this application, and for the sake of convenience and simplicity, the terms corner board, cornerboard, edge board, edgeboard, angle board, and angleboard may be used interchangeably herein, and use of one such term generally includes the others, unless indicated otherwise from the context of its use herein.

Technical aspects of embodiments of the present invention will be more fully and clearly described in conjunction with the drawings in the following embodiments. It will be understood that the descriptions are not intended to limit the invention to these embodiments. Based on the described embodiments of the present invention, other embodiments can be obtained and/or derived by one skilled in the art without creative contribution or effort, and are considered within the scope of legal protection given to the present invention.

Furthermore, all characteristics, measures or processes disclosed in this document, except characteristics and/or processes that are mutually exclusive, can be combined in any manner and in any combination possible, either with each other or with structures in the prior art. Any characteristic disclosed in the present specification, claims, Abstract and Figures can be replaced by other equivalent characteristics or characteristics with similar objectives, purposes and/or functions, unless specified otherwise.

Various capabilities and advantages of the present invention, both explicit and implicit, will become apparent to those skilled in the art from the description below.

Exemplary Corner Board(s)

Figure 1:
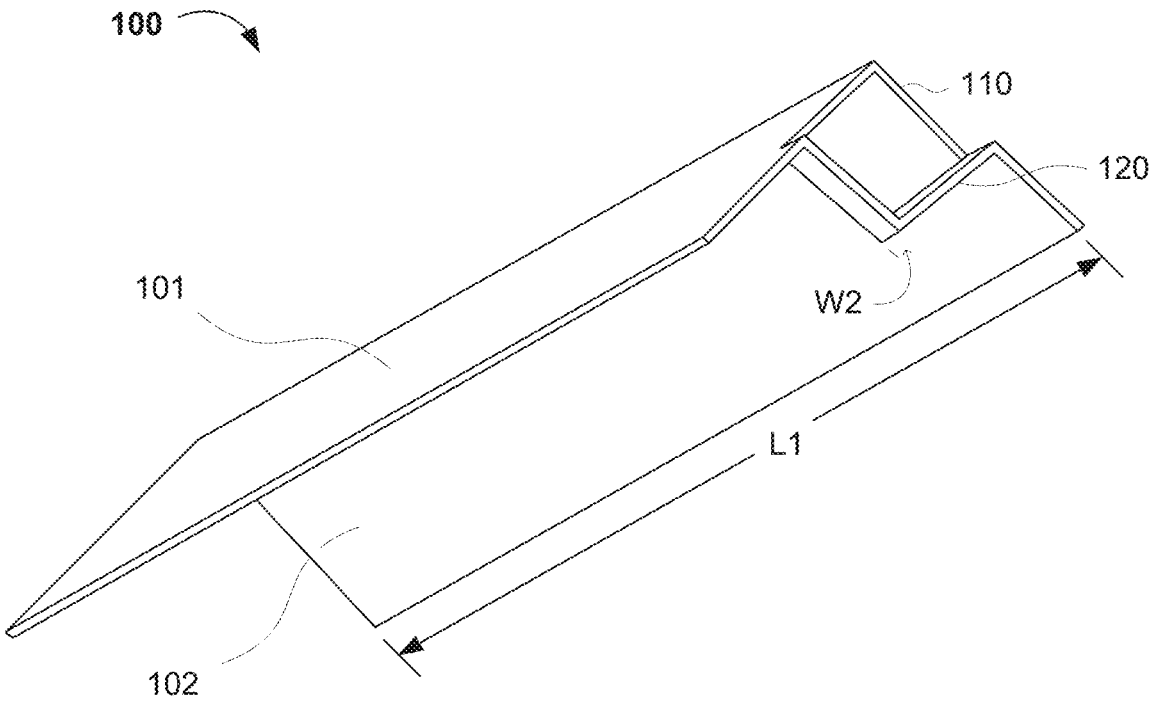
FIG. 1 is a perspective view of an exemplary notched corner board according to one or more embodiments of the present invention.
Figure 2:
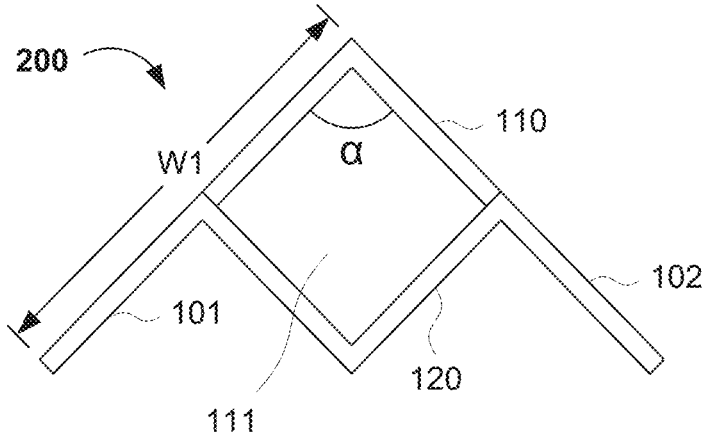
FIG. 2 is an end view of the corner board according to FIG. 1.

FIG. 1 illustrates an exemplary corner board 100 according to the present invention. In a first aspect of the present invention, the corner board 100 (which may also be known as a v-board, edge board, edge protector, corner post, ag board, protecting or protectant edge, angle board or other similar term) may comprise a stiff, angled piece of material. The exemplary corner board, as well as similar corner boards and methods of making and using the same, are disclosed in U.S. patent application Ser. No. 13/904,967, the relevant portions of which are incorporated herein by reference. A portion of the corner board may have a slit (e.g., a cutout) 110 and a notch 120 at or near one end of the corner board 100. In various embodiments of the present invention, the slit 110 is located near or adjacent to one end of the board 100, and the notch 120 is between the slit 110 and end of the corner board. The notch 120 generally extends inward from the point of origin of the angle $\alpha$, as shown in FIG. 2.

Referring back to FIG. 1, the corner board 100 may be formed from any material, such as paper, cardboard, pressboard, plastic, or any laminate or other combination thereof that has or can have a predetermined minimum stiffness. However, laminated paper, plastic or a combination thereof (such as commingled plastic) having a predetermined minimum stiffness is generally preferred. The listed materials comprise broad categories. For instance, "cardboard" may comprise any board material comprising paper and/or fiber, such as pressed and/or corrugated cardboard, fiberboard, paperboard, boxboard and/or containerboard. The corner board 100 may further comprise an overwrap (e.g., paper) and/or a laminate of cardboard and another material (such as plastic). In further embodiments, the overwrap may comprise either a full overwrap or a partial overwrap (e.g., with edges of the corner board being exposed). In some embodiments, the laminate may comprise one or more layers of paper and/or cardboard and one or more sheets or layers of plastic and/or wax.

In the embodiment of FIG. 1, the corner board 100 comprises a plurality of sides. Generally, the corner board 100 has two sides 101, 102. Each side 101, 102 of the corner board 100 is generally rectangular. However, in other embodiments, the sides of the corner board can be square, triangular, trapezoidal, or any other suitable, desired or predetermined shape.

The corner board 100 can have any thickness suitable for protecting the edge of a container and/or group (e.g., stack) of containers. In some embodiments, the thickness of the corner board 100 may be the same thickness as the material used to create the corner board 100. In one embodiment, the corner board 100 may have a thickness of about 0.16 in. (0.4 cm). In other embodiments, the thickness can be in the range of 0.08 in. (0.2 cm) to 0.50 in. (1.3 cm), and can include a thickness of about 0.12 in. (0.3 cm), 0.2 in. (0.5 cm) or 0.25 in. (0.6 cm). Alternatively, the corner board 100 can have an inner thickness $T_2$ less than an outer thickness $T_1$ (see, e.g., U.S. Pat. No. 5,813,537, which discloses a so-called "apex" board), or alternatively, greater than the outer thickness $T_1$, as shown in FIG. 1B. For example, $T_2$ may be in the range of 0.12 in. to 0.50 in. (e.g., about 0.16 in.), and $T_1$ may be in the range of 0.08 in. to 0.375 in. (e.g., about 0.12 in.), or vice versa.

Referring back to FIG. 1, a length L1 of the sides 101, 102 of the corner board 100 may be any length suitable for protecting the edge of a container and/or group of containers. In preferred embodiments, the length L1 of the sides 101, 102 of the corner board 100 is about 24 in. (60 cm) to about 90 in. (230 cm). However, it should be readily understood that the length L1 of the sides 101, 102 of the corner board 100 can be any value in the range, or more or less than such a range. In general, the thicker the corner board 100, the greater the length L1. For example, when the corner board 100 has a length of about 24 in. (60 cm) to 36 in. (90 cm), the thickness may be from about 0.12 in. (0.3 cm) to about 0.2 in. (0.5 cm). When the corner board 100 has a length of about 36 in. (90 cm) to 48 in. (120 cm), the thickness may be from about 0.16 in. (0.4 cm) to about 0.25 in. (0.625 cm). Furthermore, when the corner board 100 has a length of about 48 in. (120 cm) to 72 in. (180 cm), the thickness may be from about 0.25 in. (0.625 cm) to about 0.5 in (1.25 cm).

Referring to FIG. 2, a width W1 of the sides 101, 102 of the corner board 200 may be any width suitable for protecting the edge of a container and/or group of containers, and facilitating support for a stack of containers. In preferred embodiments, the width W1 of each side 101, 102 of the corner board 100 is about 1 in. (2.5 cm) to about 4 in. (10 cm). However, it should be readily understood that the width W1 of the sides 101, 102 of the corner board 100 can be any value in the range, or more or less than such a range.

The slit 110 as shown on the corner board 100 in FIG. 1 may be located at any suitable and/or a predetermined distance from the end (e.g., a first end) of the corner board 100, while still allowing the corner board 100 to rest on the container (as subsequently shown in FIG. 4). Also, the longer the corner board 100, the greater the distance of the slit 110 from the end of the corner board 100. Similarly, the thicker the corner board, the greater the distance of the slit 110 from the end of the corner board 100. For example, when the corner board 100 has a length of about 24 in. (60 cm) to 48 in. (120 cm), the distance may be from about 0.12 in. (0.3 cm) to about 0.375 in. (0.95 cm). When the corner board 100 has a length of about 48 in. (120 cm) to 60 in. (150 cm), the distance may be from about 0.375 in. (0.95 cm) to about 0.5 in (1.25 cm).

The notch 120 may comprise the material and/or a portion of the corner board 100 between the slit 110 and the end of the corner board 100. As shown in FIG. 2, the notch 120 may have an angle opposite to the angle $\alpha$ of the corner board 100. Generally, the notch extends inward from the bend, the bend has an angle $\alpha$ of less than 180°, and the notch has an angle of less than 180° facing the angle $\alpha$ of the bend of the corner board 100. In one example, the bend may have an angle $\alpha$ of about 90°, and the notch has an angle of about 90° facing the angle of the bend. However, due to variations in board quality and the meeting process, the notch may have an angle of from about 60° to about 120° facing the angle of the bend (typically between 90° and) 105°. In another embodiment, if the corner board 100 is made from a molded material, such as plastic, the notch 120 may run generally straight across between the two end points of the slit 110 (e.g., the notch has an angle of 0°). An opening 111 is formed between the slit 100 and the end of the corner board 100, as shown in FIG. 2. The opening 111 may have, but is not limited to, a diamond shaped opening, an A-shaped opening, or other various opening shapes, depending on the shape and/or size of the corner board, the slit in the corner board, the containers, and/or the stack of containers. Alternatively, the notch 120 may take on any form of a hanging notch or a notch that has the capability and adjustability to hang on the end of the corner board 100.

Referring back to FIG. 1, a distance (W2) from the end of the corner board 300 to the slit 110 of FIG. 1 may vary, depending on the type and/or thickness of material used to create the corner board 100. For example, a width W2 of the notch 120 of FIG. 1 may be from about 0.12 in. to about 1 in. (e.g., about 0.3 cm to about 2.5 cm). In one embodiment, the predetermined distance (W2) from the slit 110 to the end of the corner board is about 0.37 in. (e.g., about 1 cm) when the corner board 100 has a thickness of about 0.16 in. (e.g., 0.6 cm) or greater. In various embodiments, the predetermined distance (W2) from the slit 110 to the end of the corner board may be about 0.5 cm to about 2 cm. However, one skilled in the art will readily understand that the distance can be any suitable distance that achieves the objectives of the present invention. In further embodiments, when the corner board 100 is less than 0.16 in. (e.g. 0.6 cm), the slit 110 may be 0.63 in. (e.g. about 1.5 cm) from the end of the corner board 100. In further embodiments, the predetermined distance (W2) from the slit 110 to the end of the corner board may be about 0.75 cm to about 3 cm when the corner board has a thickness of less than 0.6 cm.

The length and/or depth (L2) of the slit 110 may be any suitable value that provides for a suitable notch 120 and/or provides for the corner board 100 to rest on one or more containers. Generally, the depth (L2) of the slit 110 is a predetermined percentage of the width W1 of each side 101, 102 of the corner board 100. For example, depth (L2) of the slit 110 may be from 20-80% of the width W1 (see FIG. 2) of each side of the corner board 100, or any value or range of values therein (e.g., 30-60%, about 50%, etc.), preferably 30-50% of the width of each of the first and second sides 101, 102. Typically, first and second sides 101, 102 have identical widths.

Furthermore, the angle of the corner board 100 and the angle of the notch 120 may depend on the shape of the container and/or stack of containers. Generally, the angle of the notch 120 can be any value that provides or allows for the corner board 100 to rest on and/or against the corner of a container, in which the angle of the notch 120 should be proportional to the angle of a commercially available container(s). However, an angle $\alpha$ of about 90 degrees is generally preferred.

An Exemplary Apparatus for Manufacturing Notched Corner Boards

Figure 3:
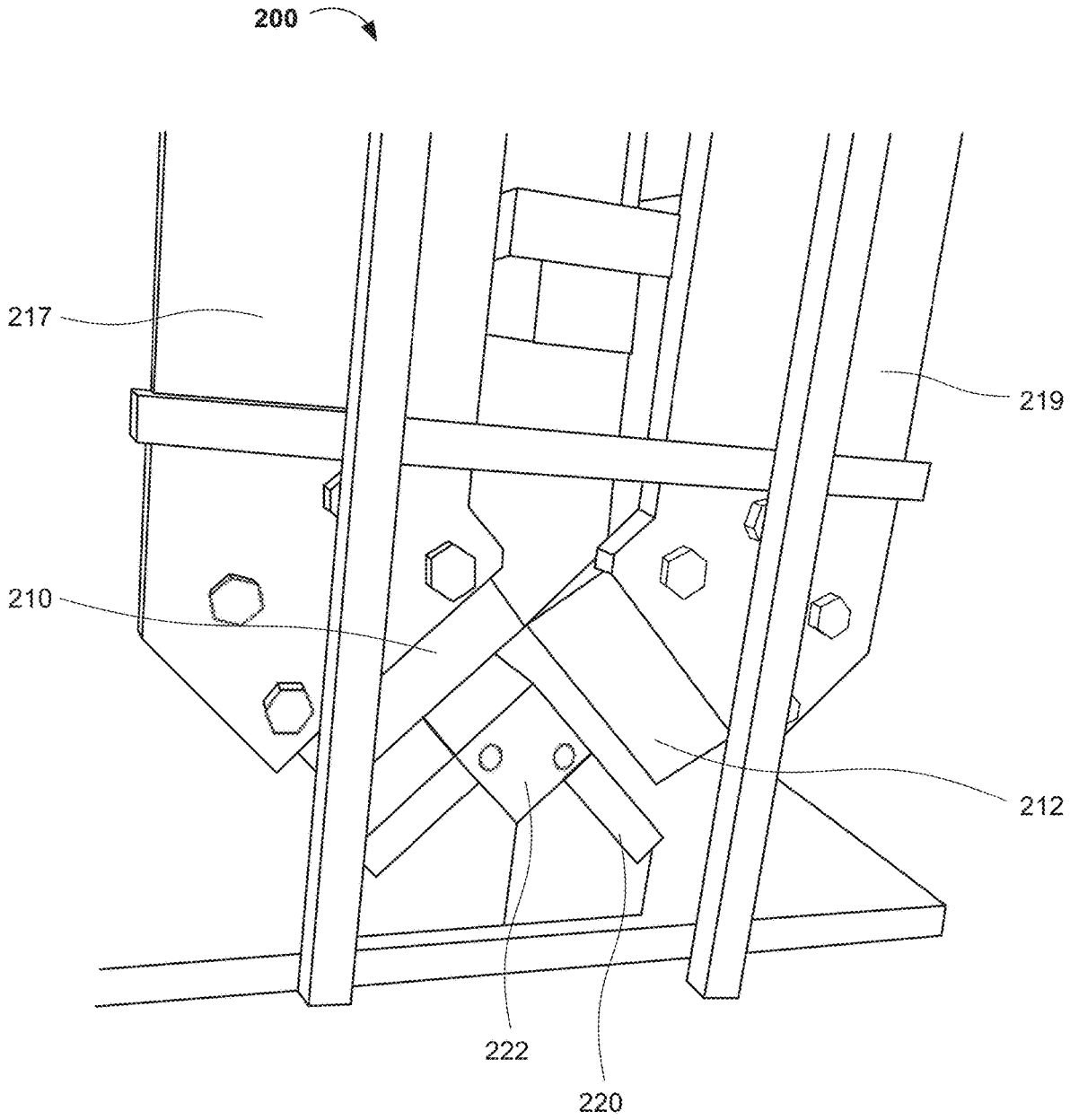
FIG. 3 is a front view of an exemplary apparatus or machine for making a notched corner board according to one or more embodiments of the present invention.

FIG. 3 is a front view of an exemplary apparatus or machine 200 for manufacturing the corner board of FIGS. 1-2 according to one or more embodiments of the present invention. The apparatus or machine 200 includes cutting tools (e.g., knives or blades) 210 and 212, and support block 220 with a retractable portion 222. The cutting tools 210 and 212 are secured to supports 217 and 219 (e.g., with bolts and nuts, but optionally, by screws, welding, etc.) that are raised and lowered (e.g., using a conventional piston-based motor; not shown). The cutting tools 210 and 212 are positioned at an angle that matches that of the support block 220 and the corner board (not shown).

Figure 4:
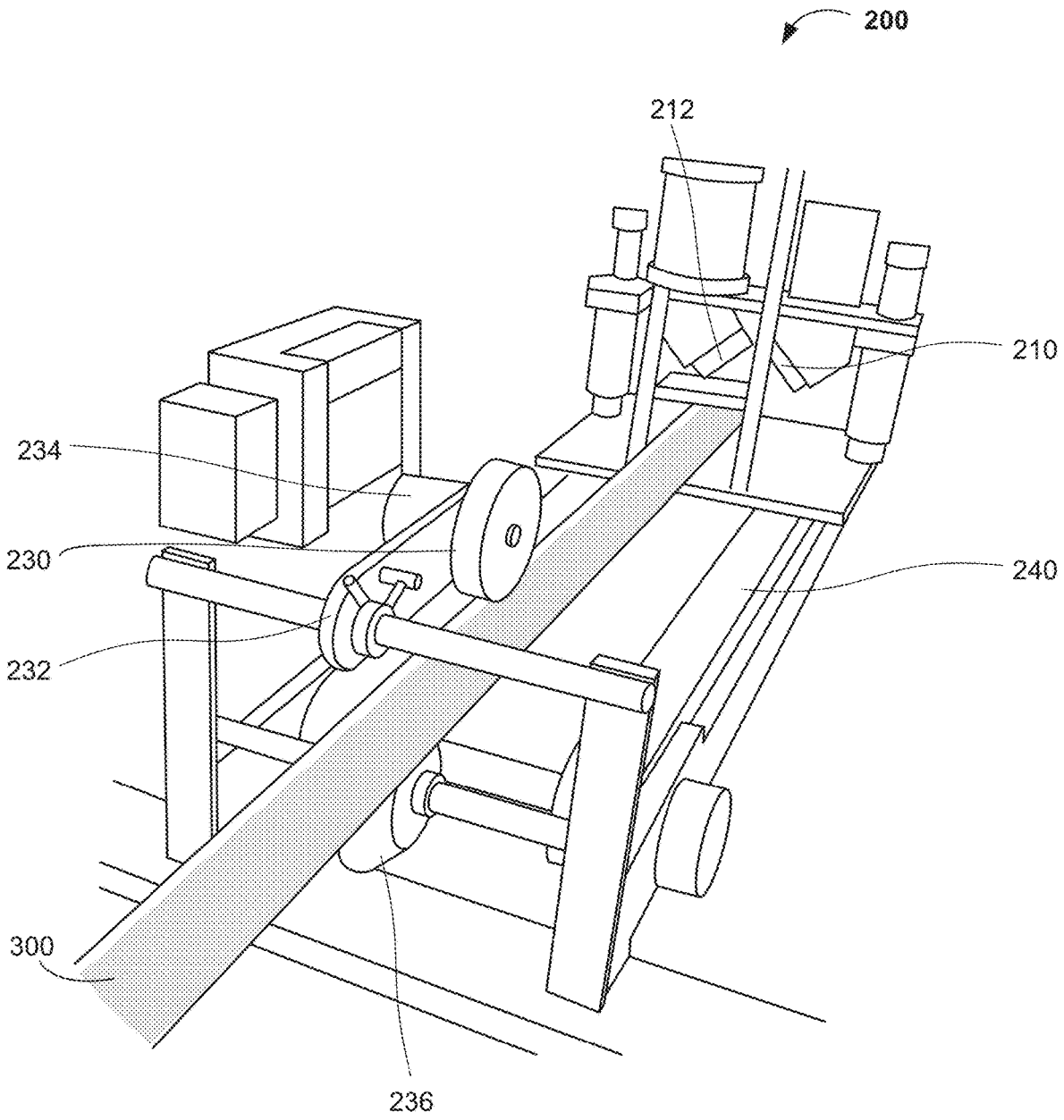
FIG. 4 is a rear perspective view of the exemplary apparatus or machine for making a notched corner board according to one or more embodiments of the present invention.

FIG. 4 is a rear perspective view of the exemplary apparatus or machine 200 for making a notched corner board according to one or more embodiments of the present invention. The uncut (or rough cut) corner board stock 300 is fed along rollers 230 and 236 into the back of the cutting portion (or cutter) of FIG. 3, including cutting tools 210 and 212. A motor (not shown) may drive rotation of the roller 236 to feed the board stock into the cutter at a set or predetermined rate or velocity. Roller 230 may have one or more functions, including guiding the board stock 300 into the cutter, driving the board stock 300 into the cutter (e.g., at the same rate or velocity as roller 236, using an identical or similar motor 234), and/or measuring the length of board stock fed into the cutter (e.g., using a conventional wheel-based or rotary motion-based electronic meter [not shown]). The roller 230 is mounted on a pivoting/rotary arm 232.

Figure 5:
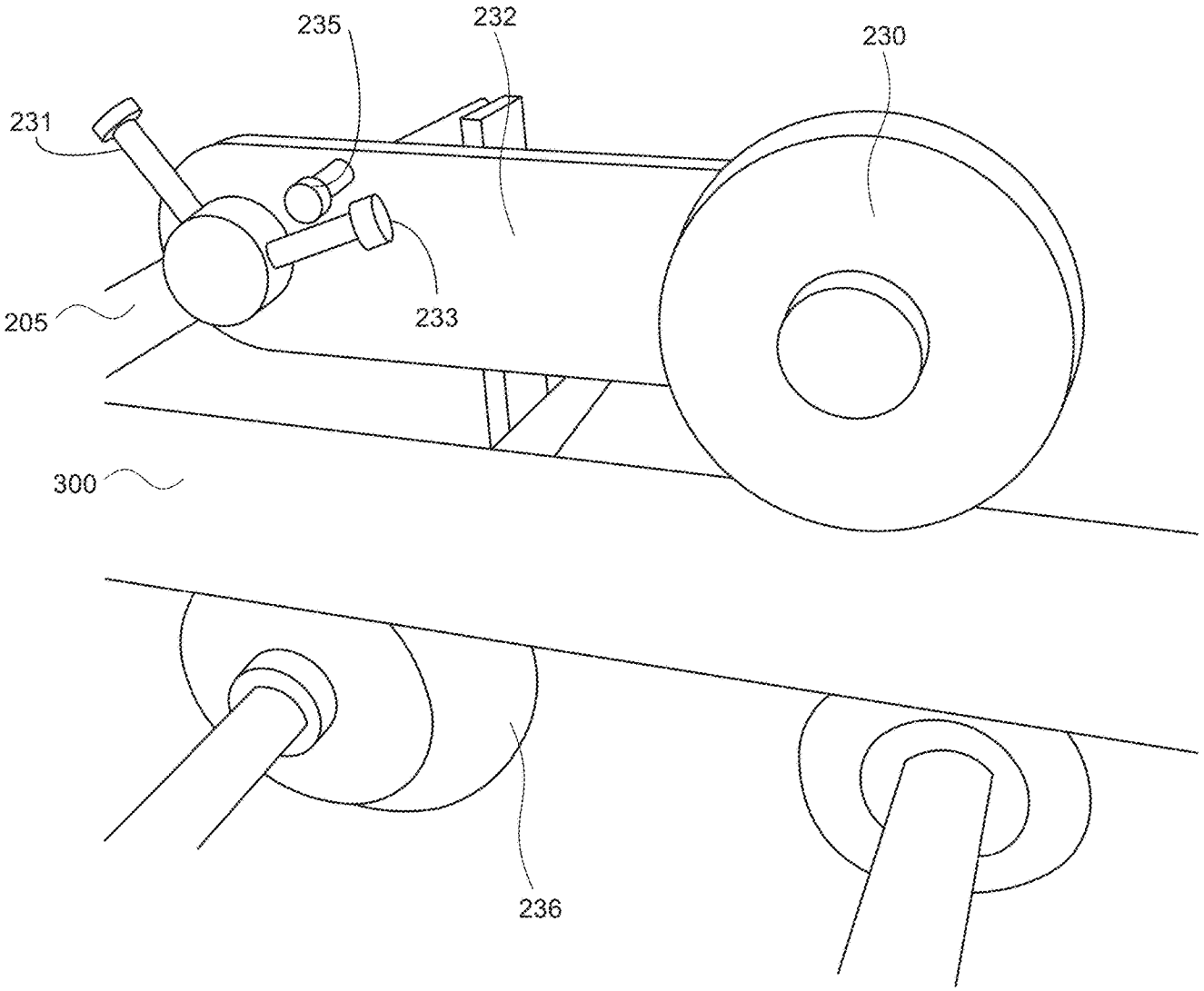
FIG. 5 is a side view of an exemplary corner board guide and measuring device according to an embodiment of the present invention.

FIG. 5 is a side view of an exemplary corner board guide and measuring device according to an embodiment of the present invention. As mentioned above, roller 230 may (i) guide or drive the board stock 300 into the cutter and (ii) measure the length of board stock fed into the cutter, and roller 236 may drive and/or feed the board stock into the cutter at a set or predetermined rate or velocity. To facilitate the initial feed of the board stock 300 into the cutter, the arm 232 on which roller 230 is mounted may pivot or rotate (e.g., around a bar or frame piece 205). Excessive rotation of the arm 232 may be prevented by rotation stops 231 and 233, and a peg 235 or similar feature on the arm 232 positioned between the rotation stops 231 and 233.

Figure 6:
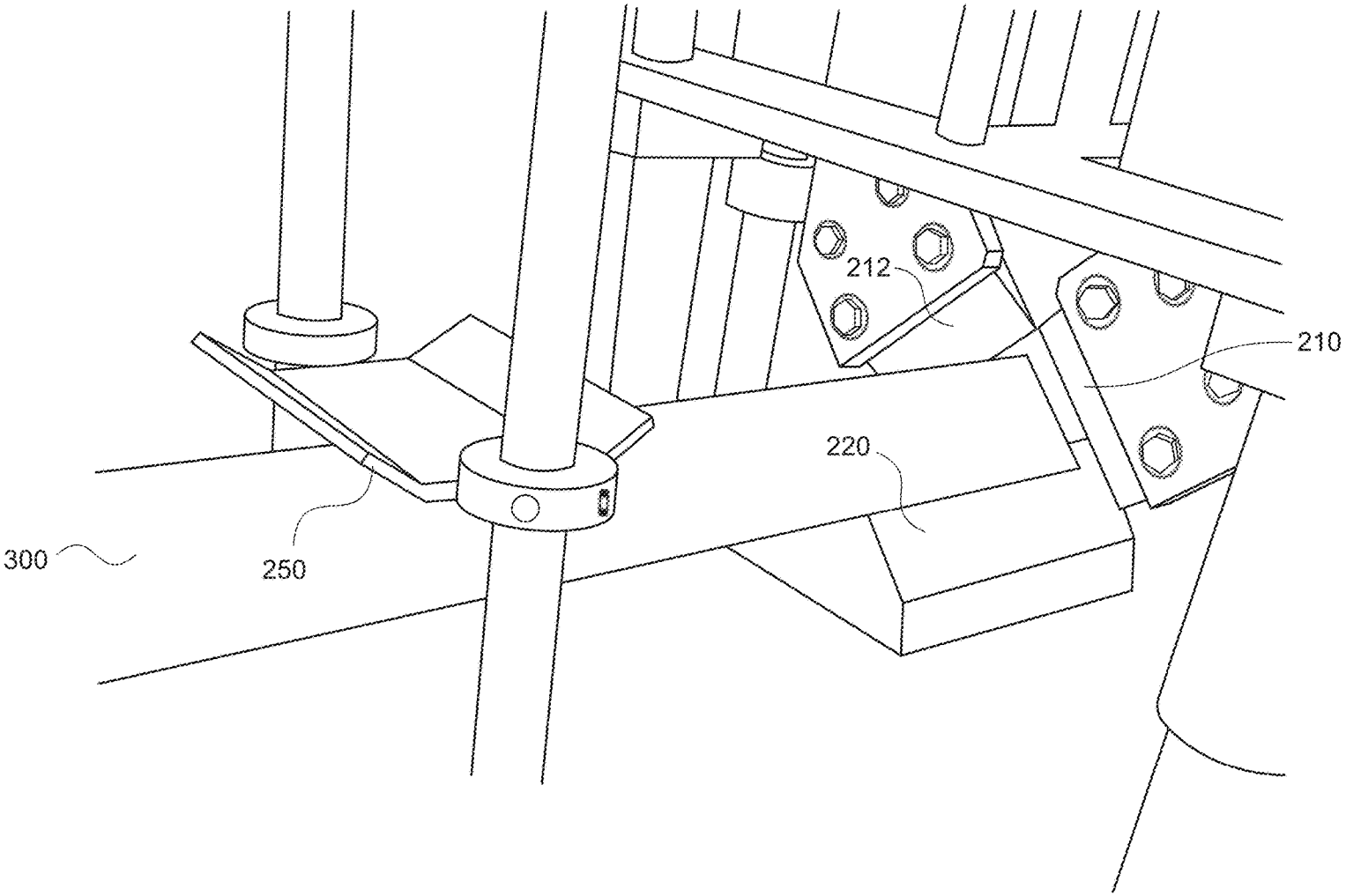
FIG. 6 is a rear perspective view of an exemplary cutting and notching device for making a notched corner board according to an embodiment of the present invention.

FIG. 6 is a rear perspective view of an exemplary cutting and notching device for making a notched corner board according to an embodiment of the present invention. The cutting and notching device includes cutting tools 210 and 212, support block 220 (and the retractable portion 222; not shown in FIG. 6), and a guide plate 250. The guide plate 250 keeps the board stock 300 in place as the board stock 300 is cut and notched. The cutting tools 210 and 212 may each include a front blade configured to cut through the entire thickness of the board stock across an entire side of the board stock 300 when the supports 217 and 219 (FIG. 3) are lowered, and a rear blade (not visible) configured to cut a slit through a part of one side of the board stock 300 when the supports 217 and 219 are lowered. Alternatively, the rear blades can be attached to or mounted on supports separate from the supports 217 and 219.

Figure 7:
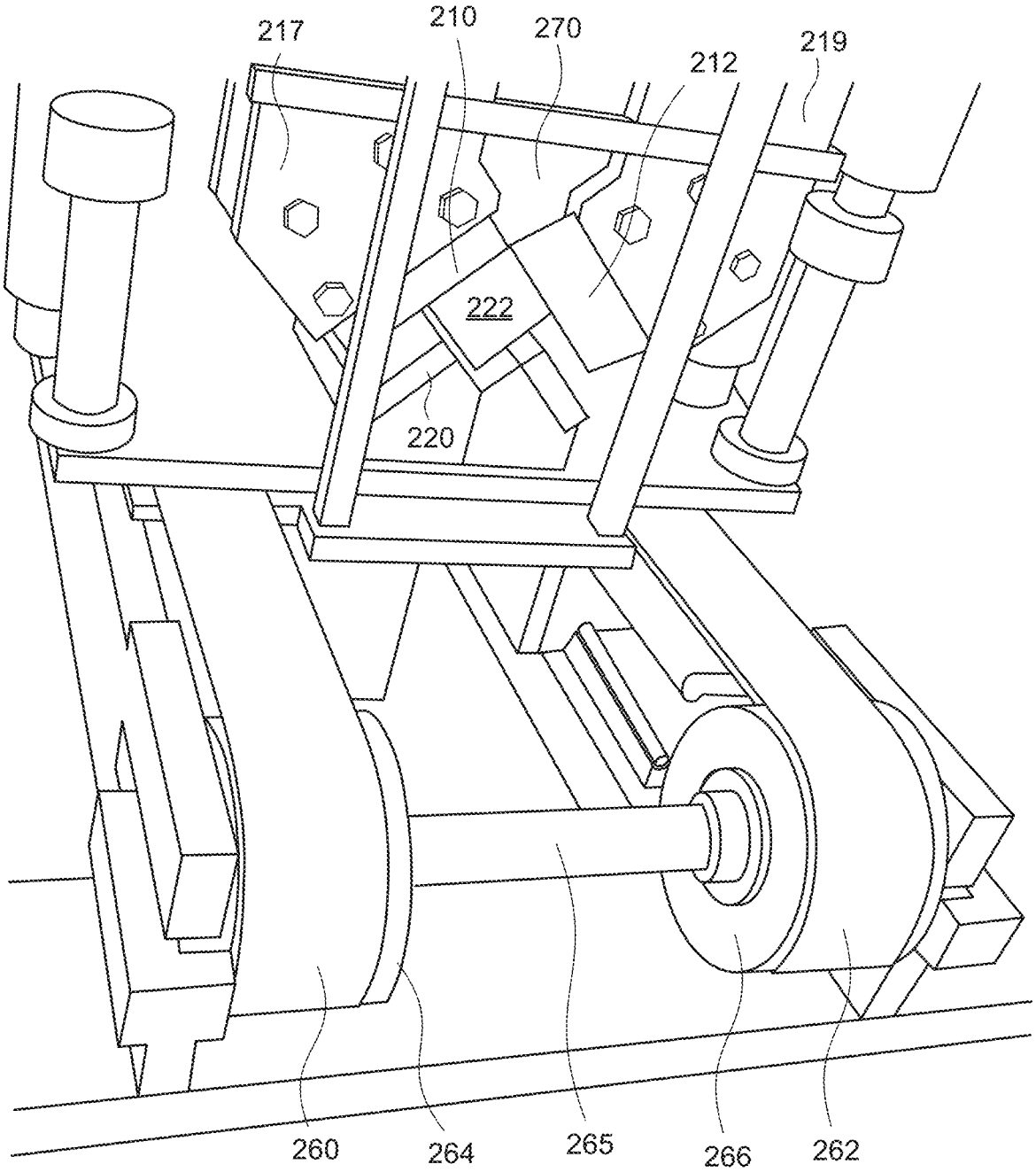
FIG. 7 is a front view of the exemplary apparatus or machine for making a notched corner board according to one or more embodiments of the present invention, on belts configured to move the apparatus or machine backward and forward along the length of the corner board.

FIG. 7 is a front view of the exemplary apparatus or machine for making a notched corner board according to one or more embodiments of the present invention, on belts 260 and 262 configured to move the apparatus or machine 200 backward and forward along the length of the corner board 300 (not shown in FIG. 7). The rollers 230 and 236 (FIGS. 4-5) do not move forward or backward when the apparatus or machine 200 is moving on the belts 260 and 262. Referring back to FIG. 7, the belts 260 and 262 are driven by wheels or gears 264 and 266 on a rotating shaft 265, which is driven by a motor (not shown). There may be a single belt, or more than two belts (and a corresponding number of wheels), depending on design considerations (e.g., the size and/or weight of the apparatus or machine 200, etc.). The apparatus or machine 200 is intended for continuous operation.

When the board stock is initially fed into the apparatus or machine 200, the belts move the cutting and notching apparatus to its rearmost position. This position can be set in advance, and changed depending on the configuration of the board, capabilities of the apparatus or machine 200, feed rate of the board, etc. When the front edge of the board stock 300 reaches the back of the cutting tools 210 and 212, the belts 260 and 262 can move the apparatus or machine 200 forward at the same rate that the board stock 300 is fed into the apparatus or machine 200. As the apparatus or machine 200 moves forward, supports 217 and 219 are lowered, and the cutting tools 210 and 212 (or blades or other cutting tools behind the cutting tools 210 and 212) cut the slits in the board stock a predetermined distance from the front edge of the board. When the apparatus or machine 200 is in continuous operation, the cutting tools 210 and 212 cut the slit board stock that was fed through the cutting and notching apparatus after the previous cutting and notching operation (i.e., cutting and slitting the board may be performed simultaneously). While the apparatus or machine 200 moves forward, after the board is slit, the retractable portion 222 of the support block 220 retracts, and a punch 270 moves downward to push the portion of the board stock between the front edge and the slit down, thereby forming the notch (e.g., 120 in FIGS. 1-2). The punch 270 may have a lowermost surface complementary to that of the notch 120, and its movements down and up may be controlled by a motor (e.g., a servo motor, a piston-based motor, etc.). Various punches and other notch-forming equipment/components are described in U.S. patent application Ser. No. 13/904,967, the relevant portion(s) of which are incorporated herein by reference. When the apparatus or machine 200 completes the notching operation, either before or as it reaches its forwardmost position (which can be set or determined using control electronics and a display/data entry panel [FIGS. 8-9]), the apparatus or machine 200 is moved back to its rearmost position as board stock is fed through the cutting and notching apparatus, and the retractable portion 222 of the support block 220 returned to its original position (e.g., with its forwardmost surface parallel or substantially parallel with the rest of the support block 220). When a predetermined or preset length of board stock is fed into the apparatus or machine 200, the cutting and notching operation is repeated.

Figure 8:
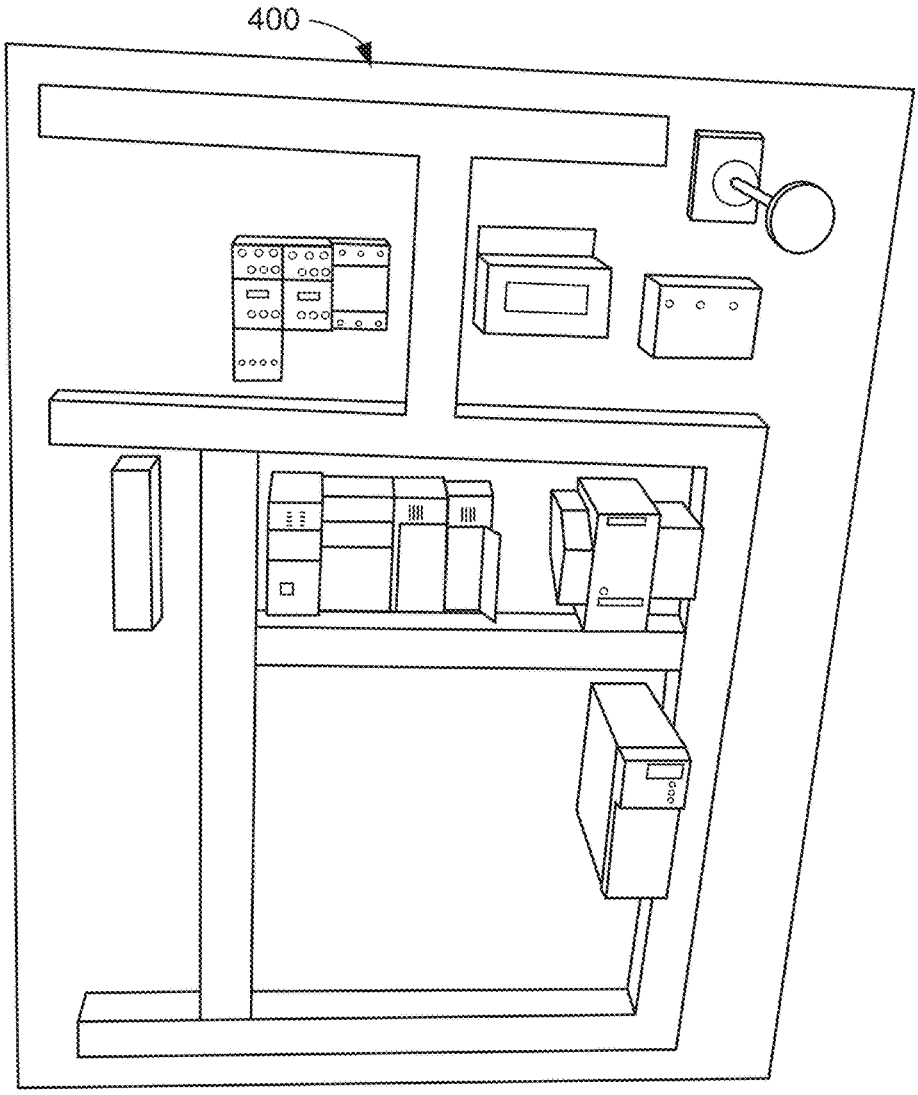
FIG. 8 is a view of exemplary electronics for operating and/or controlling various components the exemplary apparatus or machine for making notched corner boards according to one or more embodiments of the present invention.

FIG. 8 is a view of exemplary electronics for operating and/or controlling various components the exemplary apparatus or machine 200 for making notched corner boards according to one or more embodiments of the present invention. The exemplary electronics includes controllers and wiring for the various components (e.g., motors, safety features, lighting, etc.), and at least one programmable controller for controlling and/or programming the component controllers. The exemplary electronics may further include regulatory and/or safety equipment, such as an AC-to-DC converter, a voltage regulator, circuit breakers or fuses, etc. It is within the skill level of those in the art to design and construct such electronics and/or electronic controls. The exemplary electronics is generally enclosed within a housing or cabinet 400.

Figure 9:
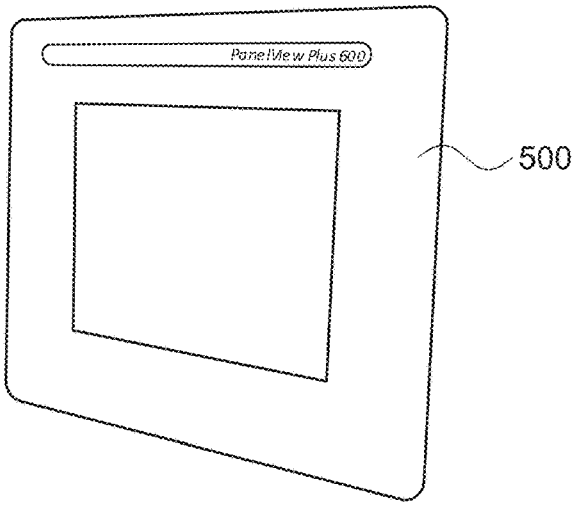
FIG. 9 is a view of an exemplary panel for viewing, entering and/or changing settings in the exemplary apparatus or machine for making notched corner boards according to an embodiment of the present invention.
Figure 10:
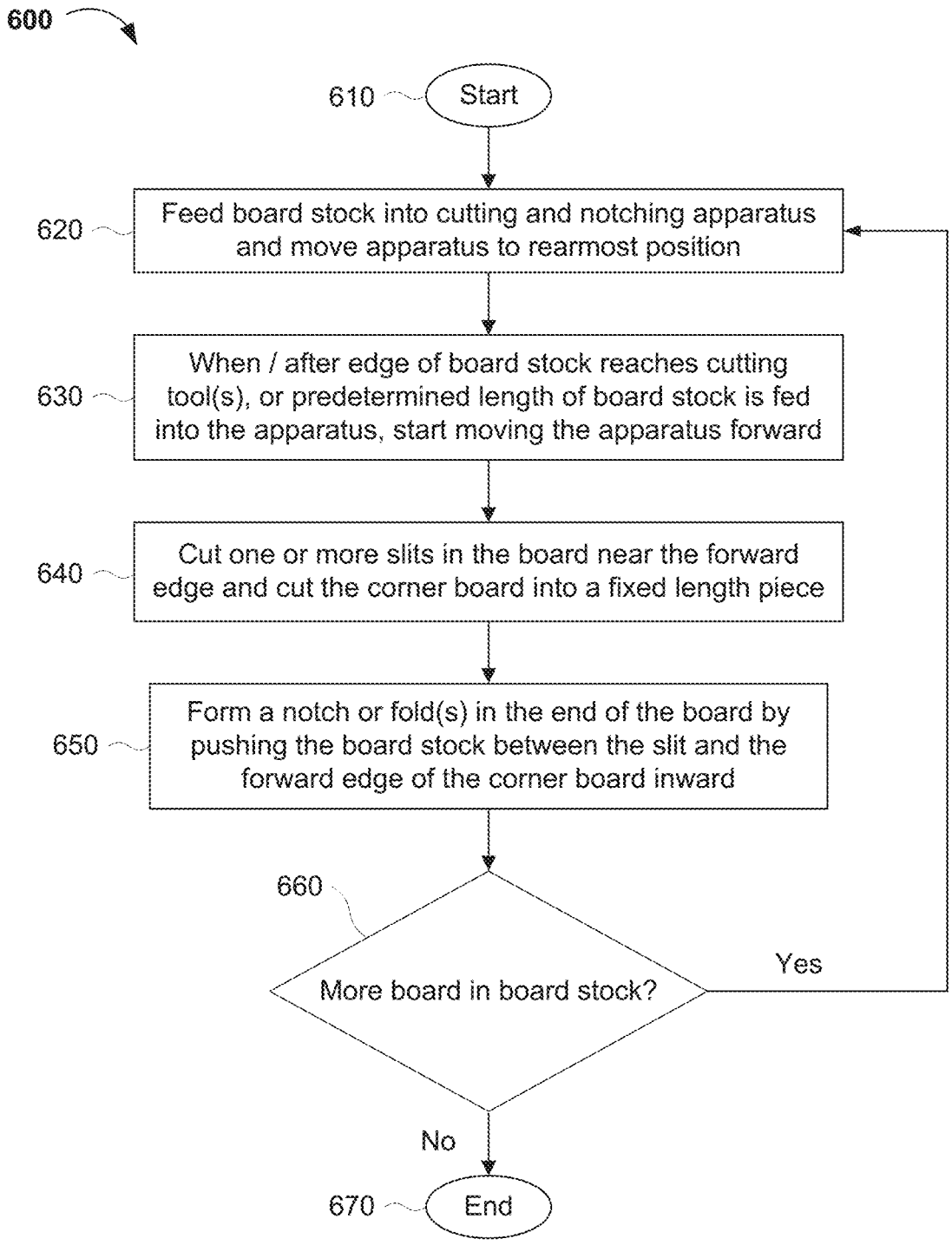
FIG. 10 is a flow chart of an exemplary method of manufacturing notched corner boards in accordance with FIGS. 1-2, in accordance with one or more embodiments of the present invention.

FIG. 9 is a view of an exemplary panel 500 for viewing, entering and/or changing settings in the exemplary apparatus or machine for making notched corner boards according to an embodiment of the present invention. The exemplary panel 500 is conventional, and displays data entry fields for programming the apparatus or machine 200, as well as settings and/or readings of the apparatus or machine 200. For example, an operator may start and stop operation of the apparatus or machine 200, set or change the length of the notched or foldable corner boards, the width and/or length of the notch, the feed rate of the board stock (within permissible limits, which may be programmed into the apparatus or machine 200 using an interface displayed on the panel 500), etc. Software for the programming and display interface(s) shown on the panel 500 may be off-the-shelf (e.g., commercially available, or sold as part of the component controller in the exemplary electronics) or written. It is within the skill level of those in the art to write, adapt, and use such software.

An Exemplary Method of Manufacturing Notched or Foldable Corner Boards

Another aspect of the present invention relates to a method of manufacturing corner boards having a notch and/or one or more folds in an end thereof in accordance with embodiments of the present invention. An exemplary method of manufacturing such corner boards (e.g., the corner boards of FIGS. 1-2 and 11A-B) is described below.

FIG. 7 shows a flow chart 600 of an exemplary method of manufacturing a notched or foldable corner board (e.g., corner board 100 of FIGS. 1-2 or corner board 700 of FIGS. 11A-B) in accordance with embodiments of the present invention. The method starts at 610, and at 620, the board stock is fed into the apparatus or machine (e.g., 200), and the cutting and notching apparatus moves to its rearmost position, as described herein. These two operations can be done simultaneously, but in general (e.g., for safety purposes), the cutting and notching apparatus should be at its rearmost position before the entire length of the board stock is fed into the apparatus or machine, or before the end of the board stock reached the cutting tools. Generally the board stock should not move backwards in the apparatus.

At 630, when (or after) a predetermined length of the board stock is fed into the apparatus or machine, or the front edge of the board stock reaches the back of the cutting tools in the apparatus, the apparatus or machine moves forward. In one embodiment, the apparatus or machine moves forward at the same rate that the board stock is fed into the apparatus or machine (i.e., once the apparatus begins moving forward). However, prior to the apparatus moving forward, the board stack can be fed into the apparatus at essentially any desired, safe rate.

At 640, one or more slits are cut in the corner board a predetermined distance (e.g., width W2 in FIG. 1 or length L3 in FIG. 11A) from the end of the corner board. Each slit is generally cut into each side of the corner board to a predetermined length (e.g., L2 in FIG. 3). The corner board is also cut into a fixed-length piece. The slit(s) may be formed and the board may be cut simultaneously or sequentially. If sequentially, the board may be cut before the slit(s) are formed. The fixed-length piece may have a predetermined length (e.g., L1 in FIG. 1) of about 24 in. (60 cm) to about 90 in. (230 cm). However, the predetermined length of the sides of the corner board can be any value in the range, or more or less than such a range.

At 650, the notch or fold(s) are formed at, near, or adjacent to the end of the board by pushing or otherwise forcing the material of the board stock between the slit and the forward end of the corner board inward, as described herein. The folds are exemplified by flaps 703*a-b* in FIGS. 11A-B. Using the exemplary apparatus 200, the notch or fold(s) are generally formed automatically, after formation of the slit(s).

At 670, it is determined whether there is more board remaining in the board stock, or enough board in the board stock remaining to form another notched or folded corner board. The amount of board remaining in the board stock can be calculated by the exemplary electronics by inputting the length of the board stock, and measuring the amount of board stock that has been fed into the cutting and notching apparatus. If there is more board in the board stock (or enough board in the board stock remaining to make another notched or folded corner board), then the method returns to 620. Otherwise, at 680, the method ends.

Another Exemplary Corner Board with Bendable Flaps

Figure 11A:
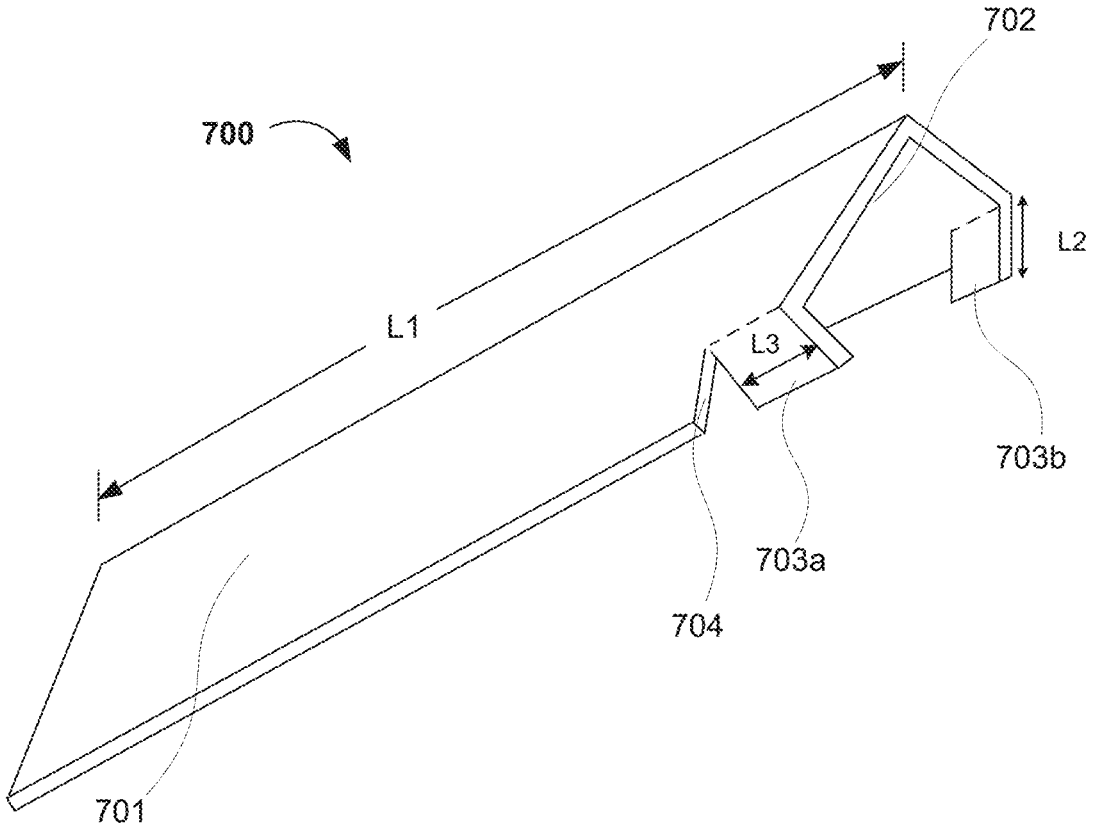
FIGS. 11A-B are perspective views of exemplary corner boards according to further embodiments of the present invention.
Figure 11B:
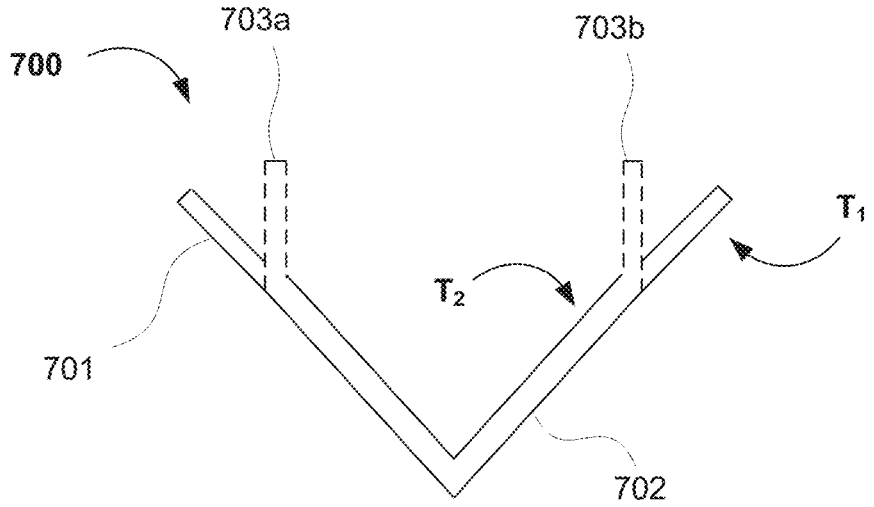

Referring now to FIGS. 11A-B, further embodiments of the present invention relate to an apparatus and method that can form one or more slits (e.g., slit 704) may be created in the main body of a corner board 700 to create bendable flaps 703*a* and 703*b*. Incisions to create such slits can be made near or adjacent to one end of the board 700 such that the flaps 703*a* and 703*b* are between the slit 704 and end of the corner board. The main difference(s) in the apparatus for making the corner board 700 is/are the location(s) of the slit-cutting tool(s) and the retractable portions(s) of the support block. As illustrated in FIGS. 11A-B, flaps 703*a* and 703*b* generally extend inward from the main body of corner board 700.

With further reference to FIG. 11A, length L1 of the sides 701, 702 of the main body 704 of the corner board 700 may be any length suitable for protecting the edge of a container and/or group of containers. In preferred embodiments, the length L1 of the sides 701, 702 of the corner board 700 is about 24 in. (60 cm) to about 90 in. (230 cm). However, it should be readily understood that the length L1 of the sides 701, 702 of the corner board 700 can be any value in the range, or more or less than such a range. In general, the thicker the corner board 700, the greater the length L1. For example, when the corner board 700 has a length of about 24 in. (60 cm) to 36 in. (90 cm), the thickness may be from about 0.12 in. (0.3 cm) to about 0.2 in. (0.5 cm). When the corner board 700 has a length of about 36 in. (90 cm) to 48 in. (120 cm), the thickness may be from about 0.16 in. (0.4 cm) to about 0.25 in. (0.625 cm). Furthermore, when the corner board 700 has a length of about 48 in. (120 cm) to 72 in. (180 cm), the thickness may be from about 0.25 in. (0.625 cm) to about 0.5 in (1.25 cm).

The flaps 703*a*, 703*b* on the corner board 700 may have any suitable width and length, and the slits 704 may be located any suitable and/or predetermined distance from the end of the corner board 700, while still allowing the corner board 700 to rest on the container. In general, the length L2 of the flaps 703*a*, 703*b* may also be suitable for protecting the edge of a container and/or group of containers, and facilitating support for a stack of containers. Also, the longer the corner board 700, generally the greater the length L2 of the flaps 703*a*, 703*b*. Similarly, the thicker the corner board, generally the greater the length L2 of the flaps 703*a*, 703*b*. For example, when the corner board 700 has a length of about 24 in. (60 cm) to 48 in. (120 cm), the length L2 may be from about 0.12 in. (0.3 cm) to about 0.5 in. (1.3 cm). When the corner board 700 has a length of about 48 in. (120 cm) to 60 in. (150 cm), the length L2 may be from about 0.375 in. (0.95 cm) to about 1.0 in. (2.5 cm).

The distance L3 from the end of the corner board 700 to the slit 704 where flaps 703*a*, 703*b* are created may vary, depending on the type and/or thickness of material used to create the corner board 700. For example, the length L3 may be from about 0.12 in. to about 1 in. (e.g., about 0.3 cm to about 2.5 cm). In one embodiment, the predetermined distance (L3) from the slit 704 to the end of the corner board is about 0.37 in. (e.g., about 1 cm) when the corner board 700 has a thickness of about 0.16 in. (e.g., 0.6 cm) or greater. In various embodiments, the predetermined distance (L3) from the slit 704 to the end of the corner board may be about 0.5 cm to about 2 cm. However, one skilled in the art will readily understand that the distance can be any suitable distance that achieves the objectives of the present invention. In further embodiments, when the corner board 700 has a thickness of less than 0.16 in. (e.g. 0.6 cm), the slit 704 may be 0.63 in. (e.g. about 1.5 cm) from the end of the corner board 700. In further embodiments, the predetermined distance (W3) from the slit 704 to the end of the corner board may be about 0.75 cm to about 3 cm when the corner board has a thickness of less than 0.6 cm.

The length and/or depth (L3) of the slit 704 (and thus of flaps 703*a*, 703*b*) may be any suitable value that allows or provides for the corner board 700 to rest on one or more containers. Generally, the depth (L3) of the slit 704 is a predetermined percentage of the width W1 (see FIG. 2) of each side 701, 702 of the corner board 700. For example, the depth (L3) of the slit 704 may be from 20-80% of the width W1 of each side of the corner board 700, or any value or range of values therein (e.g., 30-60%, about 50%, etc.), preferably 30-50% of the width of each of the first and second sides 701, 702. Typically, first and second sides 701, 702 have identical widths.

CONCLUSION/SUMMARY

Embodiments of the present invention can advantageously provide a machine or apparatus for making corner boards that may be rested or placed along a vertical edge of a container or stack of containers, without the need for additional materials or steps (e.g., staples or tape) to affix the corner board to the container or stack of containers. Thus, the present machine automates a process for making an advantageous corner board that can hold container stacks in place when the stack is wrapped with appropriate wrapping material, and that eliminates and/or minimizes the need for additional material, the risk of injury to the user and/or damage to the containers or materials therein, and cost and expenses associated therewith.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching(s). The embodiments were chosen and described in order to best explain the principles of the invention and its practical application(s), to thereby enable others skilled in the art to best utilize the invention and various embodiments with various modifications as are suited to the particular use contemplated. It is intended that the scope of the invention be defined by the claims appended hereto and their equivalents.

What is claimed is:

1. A method of manufacturing a hangable corner board, comprising:

moving an apparatus or machine that has one or more cutting tools secured to a frame to a rearmost position, the apparatus or machine having a first motor configured to move the one or more cutting tools;

feeding a bent board stock into the apparatus or machine at a set or predetermined rate or velocity by a second motor, and moving the apparatus or machine forward with the bent board stock at the set or predetermined rate or velocity;

cutting the bent board stock into fixed lengths using the apparatus or machine;

forming at least one slit in or near a first end of the corner board using the one or more cutting tools; and bending or folding a part of the corner board between the first end and the slit(s) to create a notch or flap adapted to rest, seat or hang the corner board on or from a substantially horizontal surface.

2. The method of claim 1, wherein forming said at least one slit comprises making one or more slits in the center of the corner board, at or across the bend, near to and parallel or substantially parallel with the first end of the corner board.

3. The method of claim 1, wherein forming said at least one slit comprises making two or more slits at or in an outer edge of the corner board, parallel or substantially parallel with the first end of the corner board, or in the first end of the corner board, parallel or substantially parallel with an outer edge of the corner board.

4. The method of claim 1, further comprising bending a board stock to form the bent board stock, the bent board stock having first and second sides with an angle therebetween.

5. The method of claim 4, wherein the angle between the first and second sides is about 90°.

6. The method of claim 1, further comprising supporting the apparatus or machine at the rearmost position and when moving the apparatus or machine forward with one or more belts.

7. The method of claim 1, wherein the cutting tools form the one or more slits in the bent board stock a predetermined distance from a front edge of the bent board stock as the apparatus or machine and the bent board stock move forward.

8. The method of claim 7, wherein the predetermined distance is from about 0.3 cm to about 3 cm.

9. The method of claim 8, wherein the predetermined distance is between about 0.5 cm and about 2 cm, inclusive, when the corner board has a thickness of about 0.6 cm or greater, and between about 0.75 cm to about 3 cm, inclusive, when the corner board has a thickness of less than 0.6 cm.

10. The method of claim 1, further comprising, after forming the one or more slits in the bent board stock, retracting a retractable portion of a support block configured to support the bent board stock, and pushing a portion of the bent board stock between the front edge and the slit down or inward with a punch to form the notch.

11. The method of claim 10, wherein pushing a portion of the bent board stock comprises moving the first motor towards the bent board stock to form the notch or flap when the mechanism retracts the retractable portion.

12. The method of claim 11, further comprising returning the retractable portion to its original position.

13. The method of claim 10, wherein the one or more cutting tools are positioned at an angle that matches an angle of the support block.

14. The method of claim 1, wherein cutting the bent board stock comprises cutting through an entire side of the board stock with a first cutting tool when the one or more cutting tools are lowered.

15. The method of claim 1, wherein forming the at least one slit comprises cutting the at least one slit through part of one side of the board stock with a second cutting tool when the one or more cutting tools are lowered.

16. The method of claim 1, wherein the bent board stock is cut and the at least one slit is formed simultaneously.

17. The method of claim 1, comprising sequentially cutting the bent board stock, then forming the at least one slit.

18. The method of claim 1, further comprising determining whether there is enough board remaining in the board stock to form another corner board.

19. The method of claim 18, wherein determining whether there is enough board remaining in the board stock to form another corner board comprises inputting the length of the bent board stock and measuring the amount of bent board stock that has been fed into the apparatus or machine.

20. The method of claim 1, wherein movement of the apparatus or machine is driven by a motor.

* * * * *